US010012047B1

(12) United States Patent
Alley et al.

(10) Patent No.: US 10,012,047 B1
(45) Date of Patent: Jul. 3, 2018

(54) METHOD AND SYSTEM FOR WELLBORE DEBRIS REMOVAL

(71) Applicant: Wildcat Oil Tools, LLC, The Woodlands, TX (US)

(72) Inventors: Mark F. Alley, Houston, TX (US); Bobby Sam, Kiowa, OK (US)

( * ) Notice: Subject to any disclaimer, the term of this patent is extended or adjusted under 35 U.S.C. 154(b) by 0 days.

(21) Appl. No.: 15/671,213

(22) Filed: Aug. 8, 2017

(51) Int. Cl.

| | |
|---|---|
| ***E21B 27/00*** | (2006.01) |
| ***E21B 37/00*** | (2006.01) |
| ***E21B 21/12*** | (2006.01) |
| ***E21B 41/00*** | (2006.01) |

(52) U.S. Cl.
CPC ..... *E21B 27/005* (2013.01); *E21B 21/12* (2013.01); *E21B 41/0078* (2013.01)

(58) Field of Classification Search
CPC ..... E21B 27/005; E21B 21/00; E21B 21/12; E21B 34/06; E21B 37/00; E21B 41/0078
USPC ..... 166/311, 312
See application file for complete search history.

(56) References Cited

U.S. PATENT DOCUMENTS 2,136,748 A * 11/1938 Lottinger ..... E21B 47/024 166/113
3,023,810 A * 3/1962 Anderson ..... E21B 27/005 166/227
3,120,872 A * 2/1964 Anderson ..... E21B 27/005 166/167
8,727,009 B2 * 5/2014 Davis ..... E21B 21/08 166/105.2
2010/0282472 A1 * 11/2010 Anderson ..... E21B 21/103 166/317
2010/0288492 A1 * 11/2010 Blackman ..... E21B 27/005 166/250.01
2012/0292047 A1 * 11/2012 Knobloch, Jr. ..... E21B 21/12 166/378

* cited by examiner

*Primary Examiner* — George S Gray
(74) *Attorney, Agent, or Firm* — Hulsey, P.C.

(57) ABSTRACT

A method and apparatus for removing debris from a wellbore, comprising providing a surface pump for supplying a fluid stream, a work string fluidly connected to the surface pump for passing the fluid stream from the surface pump, a tool body fluidly connected to the work string, including a plurality of tool body exit ports for passing the fluid stream from the work string into an annular space of the wellbore, and a collection chamber fluidly connected to and downhole from the tool body, for accepting uphole flow of the fluid stream including entrained wellbore debris. The fluid stream including entrained wellbore debris is drawn upward through the collection chamber, and the fluid stream from the work string and the fluid stream from the collection chamber are passed into the annular space of the wellbore. In addition, a cartridge may be inserted into the tool body.

10 Claims, 17 Drawing Sheets

100

SECTION A-A

SECTION B-B 100

SECTION C-C 100

SECTION D-D

SECTION E-E

METHOD AND SYSTEM FOR WELLBORE DEBRIS REMOVAL

FIELD OF THE INVENTION

The present disclosure relates to the field of well drilling and, more particularly to a method and system for wellbore debris removal.

BACKGROUND OF THE INVENTION

During operations to drill and complete an oil or gas well, debris such as metal cuttings, broken metal or composite parts, pieces of rock, sand, and other unwanted material may obstruct a wellbore and prevent access required for further operations in the wellbore. The debris may have accumulated in the wellbore due to normal drilling operations or due to the milling of objects such as packers, plugs or stuck tools.

A common method for wellbore debris removal involves a bottom-hole assembly ("BHA") employing reverse circulation of pumped fluid, a nozzle or narrow fluid passageway, and a debris collection chamber. Using normal circulation, pumped fluid flows from a pump at the surface through a central pipe bore, such as through a work string and any distally adjoining equipment, exiting the central pipe bore at the bottom of the wellbore, and returning up the annular space between the wall of the wellbore and the work string or adjoining equipment to the surface. In contrast, when using reverse circulation, the supplied fluid is diverted out of the central pipe bore and into the annular space before the fluid reaches the bottom of the wellbore. The diverted fluid flows through one or more nozzles or narrow fluid passageways that accelerate the fluid and induce a pressure drop as the diverted fluid flows toward the annular space. The diverted fluid flows down the annular space to the distal end of a debris collection assembly. This fluid flow agitates debris near this distal end, entrains the debris, and carries the debris into a collection chamber that includes check valves and a screen to capture the debris. In the vicinity of the upper portion of the collection chamber, the debris-entrained fluid passes through a screen or filtering mechanism. The filtering mechanism cleans the fluid of debris to a certain extent and the cleaned fluid moves on through passageways to the annular space and down to the distal end of a debris collection assembly. When the operation is complete, the bottom hole assembly is pulled to the surface and the collection chamber is emptied of collected debris.

In current reverse circulation systems, diverted fluid flows through one or more nozzles or narrow fluid passageways that accelerate the fluid and induce a pressure drop, creating suction to urge debris-entrained return fluid toward the low pressure area generated by the nozzle. This suction effect draws debris into a collection chamber for capture and subsequent extraction.

However, haphazard placing of a low pressure, high velocity flow area in relation to return fluid effuse ports or passages—for example, in the annular space—achieves inefficient suction. Further, current implementations emphasize creating a decrease in pressure and not on making any purposeful use of the kinetic energy inherent in increased fluid velocity. For example, in situations involving clogged wellbores and few or one collection chamber segments, more kinetic energy to entrain debris would be helpful. Another case of annular space fluid velocity playing a key role occurs in the event the BHA is deployed with the work string being comprised of coiled tubing rather than straight tubular segments. The nature of coiled tubing operations make it likely that the collection chamber would have very limited segments and additionally that the BHA might not have a means of rotation.

In addition, suction achieved using a low pressure flow area in the annular space cannot be adjusted for wellbore conditions or suboptimal fluid pumping capacity.

As the foregoing illustrates, what is needed in the art is an improved suction apparatus that can be customized to a particular drilling situation while remaining strong enough to withstand wellbore operations.

BRIEF SUMMARY OF THE INVENTION

The disclosed subject matter provides for a method and apparatus for removing debris from a wellbore.

In light of the above, the present disclosure provides a method and apparatus for removing debris from a wellbore, comprising providing a surface pump for supplying a fluid stream, a work string fluidly connected to the surface pump for passing the fluid stream from the surface pump, a tool body fluidly connected to the work string, including a plurality of tool body exit ports for passing the fluid stream from the work string into an annular space of the wellbore, and a collection chamber fluidly connected to and downhole from the tool body, for accepting uphole flow of the fluid stream including entrained wellbore debris. The fluid stream including entrained wellbore debris is drawn upward through the collection chamber, and the fluid stream from the work string and the fluid stream from the collection chamber are passed into the annular space of the wellbore. In addition, a cartridge may be inserted into the tool body.

The disclosed subject matter allows the suction to be achieved using a low-pressure flow area in the annular space to be adjusted for wellbore conditions or suboptimal fluid pumping capacity, allowing customization to a particular drilling situation while remaining strong enough to withstand wellbore operations.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the figures and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

For clarity, neither the wellbore itself or wellbore debris are shown in the accompanying drawings. In this description, "Venturi effect" refers to the effect created when fluid passes through a restriction, specifically the resultant change in pressure and velocity of the fluid. "Nozzle" and "Venturi nozzle" refer to, for the purposes of this description, geometrical characteristics, including a narrowed restriction, of a fluid passageway that are designed with the intent to control fluid flow in such a way as to optimize the Venturi effect. Thus, for the purposes of this description, the "Venturi nozzle" is a restrictive fluid passageway formed and integrated directly into a tool body and matching insertable cartridge.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Although the method and system for wellbore debris removal here disclosed have been described in detail herein with reference to the illustrative embodiments, it should be understood that the description is by way of example only and is not to be construed in a limiting sense. It is to be further understood, therefore, that numerous changes in the details of the embodiments of this disclosed process and additional embodiments of this method and apparatus for removing debris from a wellbore will be apparent to, and may be made by, persons of ordinary skill in the art having reference to this description. It is contemplated that all such changes and additional embodiments are within the spirit and true scope of this disclosed method and system as claimed below.

Figure 1:
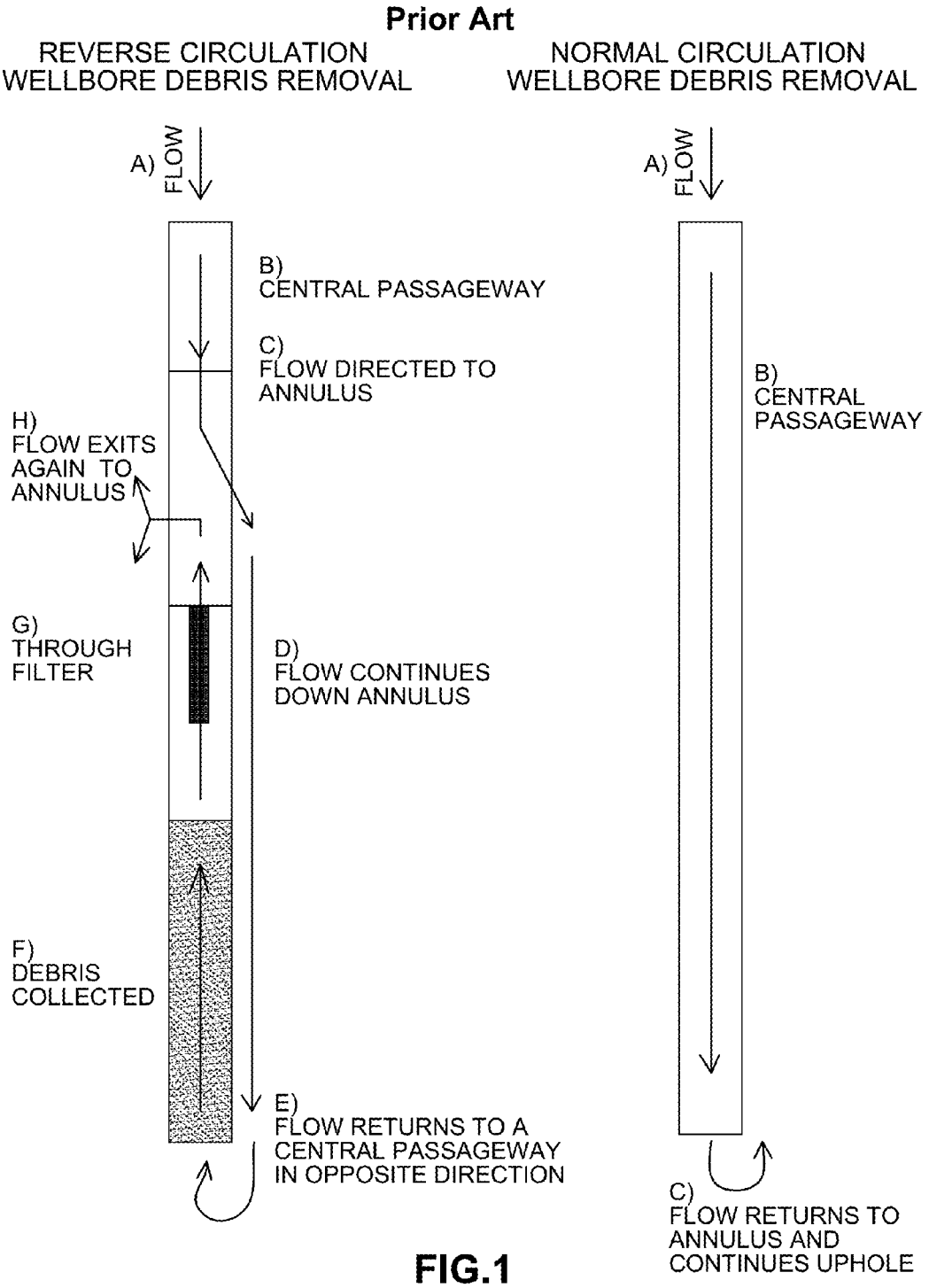
FIG. 1 illustrates the processes of normal circulation and reverse circulation as used in wellbore debris removal.

FIG. 1 depicts BHAs in schematic form, and illustrates the processes of normal circulation and reverse circulation as used in wellbore debris removal.

Using normal circulation, pumped fluid enters a central pipe bore at A, flows through the central pipe bore or central passageway (B), and exits the central pipe bore at the bottom of the wellbore (C). After exiting, the fluid returns up the annulus, the annular space between the wall of the wellbore and the work string or adjoining equipment to the surface.

Using reverse circulation, pumped fluid also enters a central pipe bore at A and flows through the central pipe bore or central passageway (B). At C, the supplied fluid is diverted out of the central pipe bore and into the annulus or annular space. At D, the diverted fluid continues down the annulus or annular space to the bottom of the wellbore (E). At E the fluid flow agitates nearby debris, entrains the debris, and carries the debris up the wellbore (F) and into a collection chamber (G) that includes check valves and a screen or filtering mechanism to capture the debris. At H the cleaned fluid exits to the annular space, where some fluid flows up toward the surface and some fluid joins fluid from the surface and continues down the annular space to the bottom of the wellbore at E.

Reverse circulation wellbore debris removal is a necessary alternative to normal circulation wellbore debris removal in various common situations. For example, surface pumping capacity may be inadequate to propel debris or small particulate matter all the way to the surface. Capturing debris in a removable collection chamber provides a means for effective removal. Some wells have poor circulation characteristics, making normal fluid return infeasible. With poor circulation and low fluid volumes, reverse circulation solves the problem as only a small amount of fluid over a relatively short distance is required to collect and remove debris.

Figure 2:
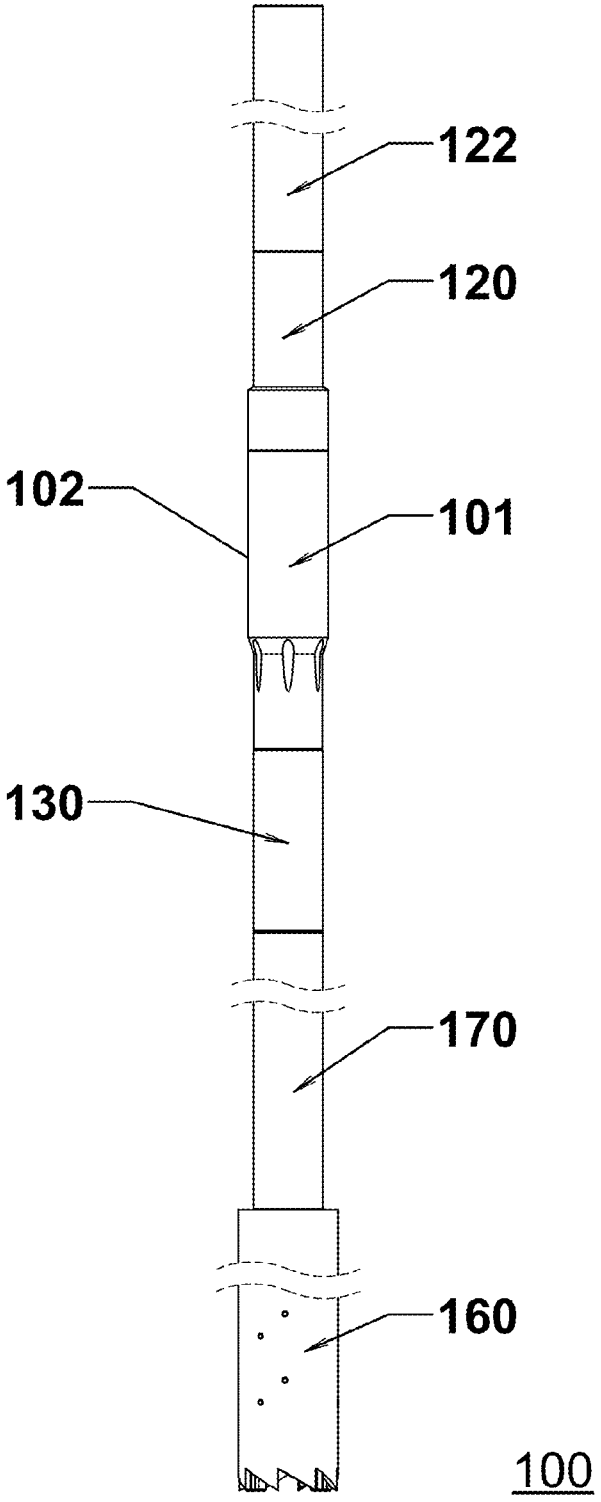
FIG. 2 illustrates an exemplary embodiment of the present invention.

FIG. 2 illustrates an exemplary embodiment 100 of the present invention. In particular, FIG. 2 shows an exterior side view that includes fluid power unit 101 as part of a bottom hole assembly ("BHA"). The BHA includes top sub adapter 120, fluid power unit 101, bottom sub adapter 130, collection chamber 170, and shoe 160. The BHA is inserted into a wellbore on a work string 122 in order to execute wellbore debris removal operations.

In operation, fluid from a surface pumping system travels through work string 122 and top sub adapter 120 and into tool body 102. The fluid flows through internal passageways within tool body 102 and exits tool body 102 into the annular space of a wellbore. Once the fluid has exited tool body 102 into the annular space, a portion of the fluid travels downward within the annular space, between the wall of the wellbore and the exterior of the BHA, to the area below shoe 160. In the area below shoe 160, the flowing fluid agitates nearby debris, entraining debris into the fluid. Suction generated in fluid power unit 101 powers the fluid stream containing entrained wellbore debris, carrying this debris into debris collection chamber 170, where it remains for subsequent extraction. The filtered fluid is drawn back into tool body 102 to be commingled with fluid from the surface and exits tool body 102 again through exit ports 104. This cycle continues for the duration of the wellbore debris removal operation, creating a loop through which fluid may pass multiple times during the operation.

Figure 3:
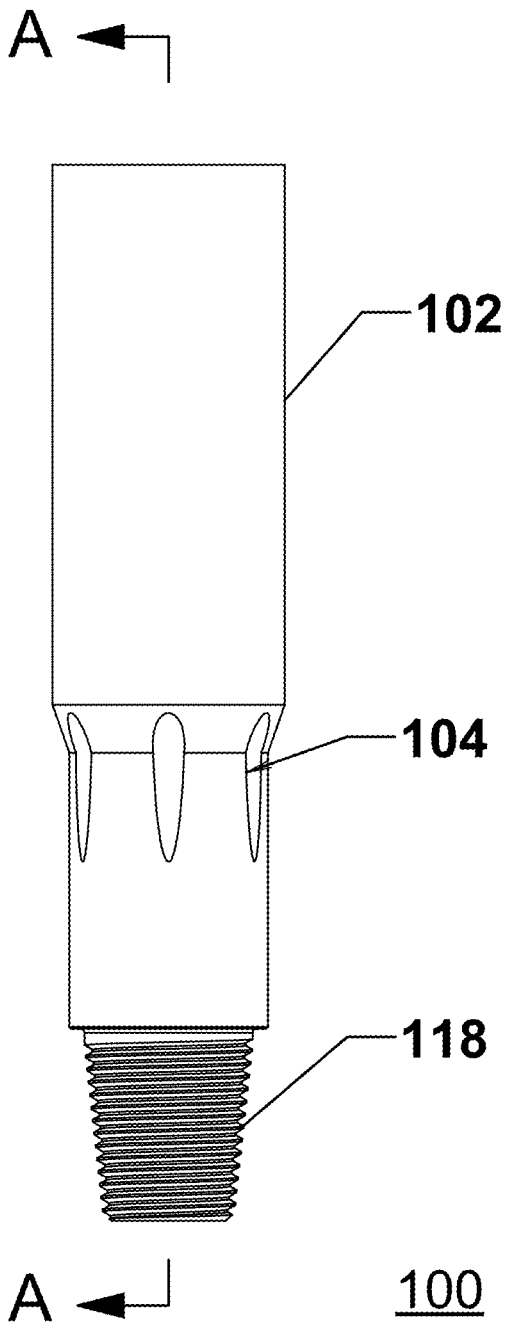
FIG. 3 illustrates a more detailed exterior side view of an exemplary embodiment of the present invention.

FIG. 3 illustrates a more detailed exterior side view of tool body 102 of exemplary embodiment 100, including exit ports 104 and tool body lower threads 118. Exemplary embodiment 100 uses six circumferentially equally spaced nozzles, and thus FIG. 3 depicts three exit ports 104 on the visible half of the exterior of tool body 102.

While exemplary embodiment 100 uses six nozzles, any number of nozzles distributed around the lateral circumference of the cartridge could be utilized to deliver circumferentially distributed fluid flow from tool body 102 into the annular space. Kinetic energy in fluid velocity in the annular space becomes more important as a debris agitation and clearing mechanism in situations with clogged wellbores and few or one collection chamber segments. For example, in a horizontal wellbore, debris may settle to the lower portion of the wellbore while leaving the upper portion relatively clear of debris. In such a case tool body 102 and other parts of the BHA may abut annular debris on the lower portion of the BHA. A circumferentially distributed flow can agitate debris abutting the lower portion of the BHA in addition to generating the suction drawing debris into the BHA.

Another case of annular space fluid velocity playing a key role occurs in the event the BHA is deployed on coiled tubing, with work string 122 being comprised of coiled tubing rather than straight tubular segments. The nature of coiled tubing operations makes it likely that collection chamber 170 would have very limited segments and additionally that the BHA may not have a means of rotation. Again, in such a case, an engineered, tuned fluid velocity in the annular space combined with the circumferentially distributed flow maximizes distribution and delivery of fluid energy and resultant debris agitation and recovery.

Figure 4:
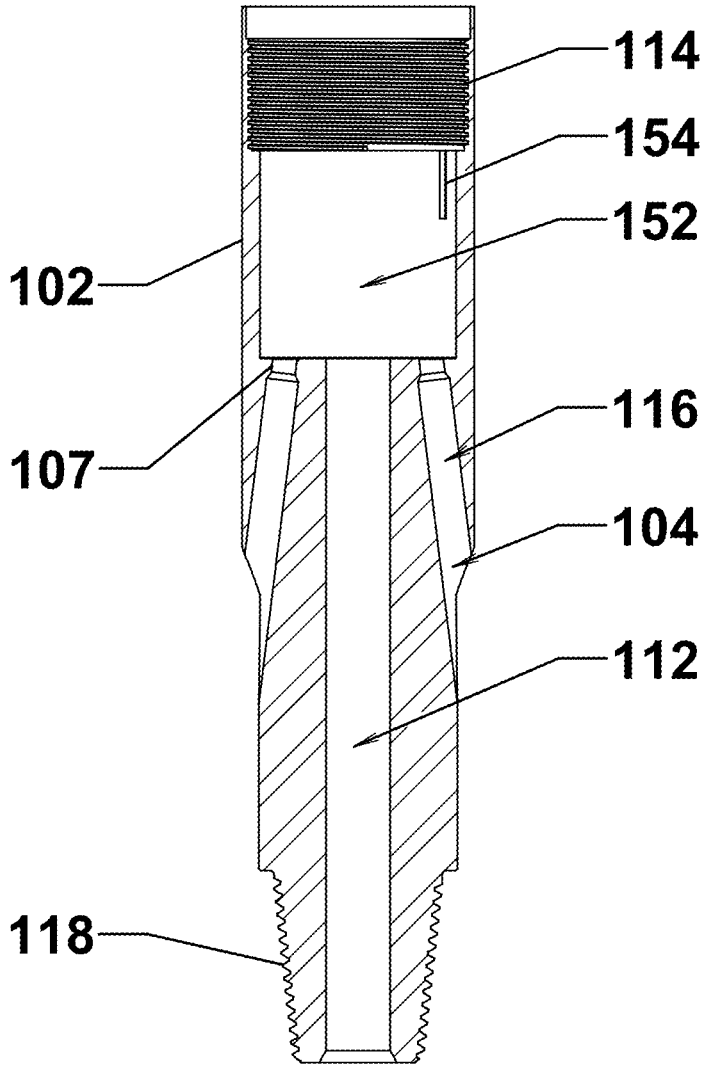
FIG. 4 depicts a side section view of a tool body of the present invention.

FIG. 4 depicts a side section view of tool body 102 of exemplary embodiment 100. Tool body central return fluid passageway 112 is disposed along the longitudinal axis of tool body 102. Cartridge cavity 152 and tool body cartridge guiding keyway 154 are inside the upper portion of tool body 102. Tool body 102 also includes at least one tool body Venturi nozzle tube 107 leading to an exit port 104. Tool body cartridge guiding keyway 154 ensures accurate insertion of a cartridge into cartridge cavity 152 so that each fluid passageway within the cartridge aligns with a corresponding tool body Venturi nozzle tube 107 in tool body 102. Fluid exits cartridge cavity 152 through tool body Venturi nozzle tube 107, mixing area 116, and exit port 104 into the annular space.

Tool body 102 must make a proper connection with other components in exemplary embodiment 100. Referring again to FIG. 4, tool body upper threads 114 are relatively fine female threads and are designed to be fine, as opposed to coarse, in order to increase strength. The tool body upper threads 114 of tool body 102 are in fact threads commonly incorporated into downhole overshot tools used in fishing operations. Top sub adapter 120 (shown in FIG. 2) attaches to tool body 102 via tool body upper threads 114. At the lower portion of tool body 102, tool body lower threads 118 connect to bottom sub adapter 130 (shown in FIG. 2). Bottom sub adapter 130 is used to cross over to other threads in segments of collection chamber 170.

Figure 5:
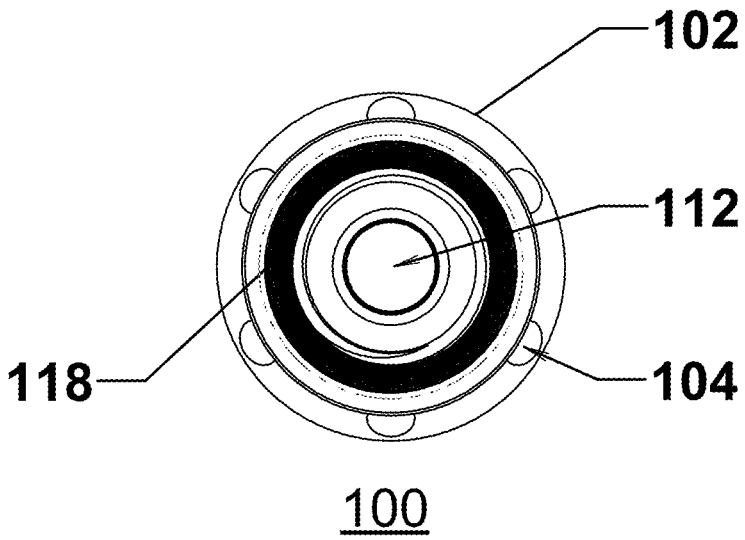
FIG. 5 depicts an underneath, bottom-up exterior view of the tool body of the present invention.

FIG. 5 depicts an underneath, bottom-up exterior view looking along the longitudinal axis of tool body 102 from below, proximal to tool body lower threads 118. Exit ports 104 are visible as well as a clear and unobstructed view through tool body central return fluid passageway 112. In a wellbore debris removal operation, fluid would be simultaneously flowing toward the viewer from exit ports 104 (between the tool exterior and wellbore wall, not shown) and away from the viewer into tool body central return fluid passageway 112.

Figure 6:
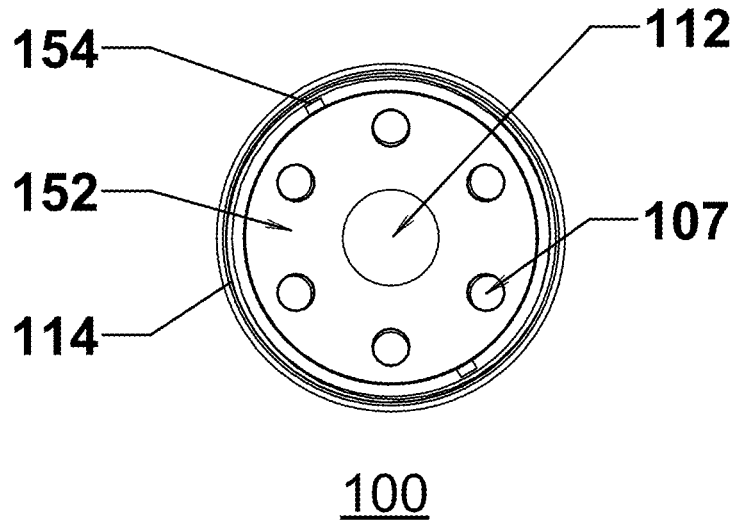
FIG. 6 depicts an overhead, top-down exterior view of the tool body of the present invention.

FIG. 6 depicts an overhead, top-down exterior view looking along the longitudinal axis of tool body 102 from above, proximal to tool body upper threads 114. Along this longitudinal axis there is a clear and unobstructed view through tool body central return fluid passageway 112 as well as a view into tool body Venturi nozzle tube 107. Cartridge cavity and tool body cartridge guiding keyway 154 are also shown.

Figure 7:
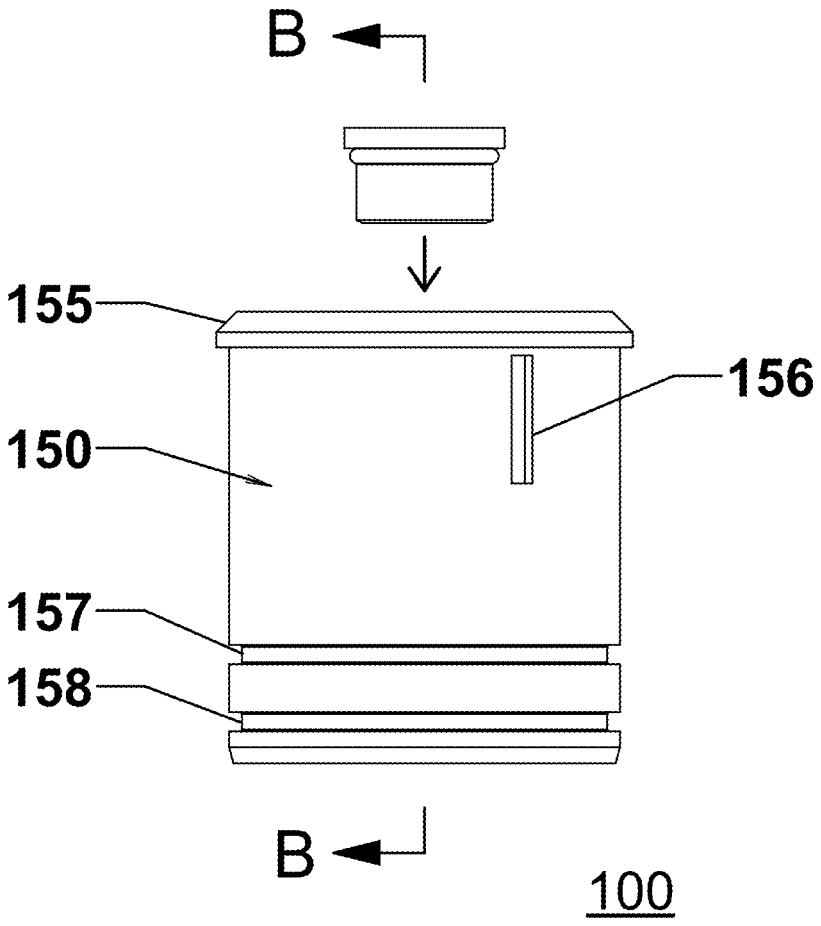
FIG. 7 depicts a side exterior view of an insertable cartridge of the present invention.

FIG. 7 depicts a side exterior view of insertable cartridge 150. Insertable cartridge 150 includes cartridge guiding keyway 156. Cartridge guiding keyway 156 functions in conjunction with tool body cartridge guiding keyway 154 and a key, not shown, but known to those skilled in the art, to ensure accurate insertion of insertable cartridge 150 into cartridge cavity 152, alignment of fluid passageways of insertable cartridge 150 and tool body 102, and resistance to rotation or torsion that could impair said alignment.

Cartridge top sub-matching profile 155 has a shape that matches the bottom end of top sub adapter 120 where top sub adapter lower threads 124 screw into tool body 102 and tighten down upon insertable cartridge 150. Cartridge top sub-matching profile 155 has a downwardly-sloping bevel to provide a self-centering profile and ensure equal distribution of compressive force for sealing. Upper cartridge seal groove 157 and lower cartridge seal groove 158 are designed to house elastomeric seals, such as O-ring type seals, and prevent flow leakage, minimal as it might be, between cartridge cavity 152 and insertable cartridge 150. A variety of sealing elements and designs could be applied in exemplary embodiment 100 by those skilled in the art, including but not limited to metal-to-metal sealing of fluid passageways in insertable cartridge 150 and tool body 102.

Figure 8:
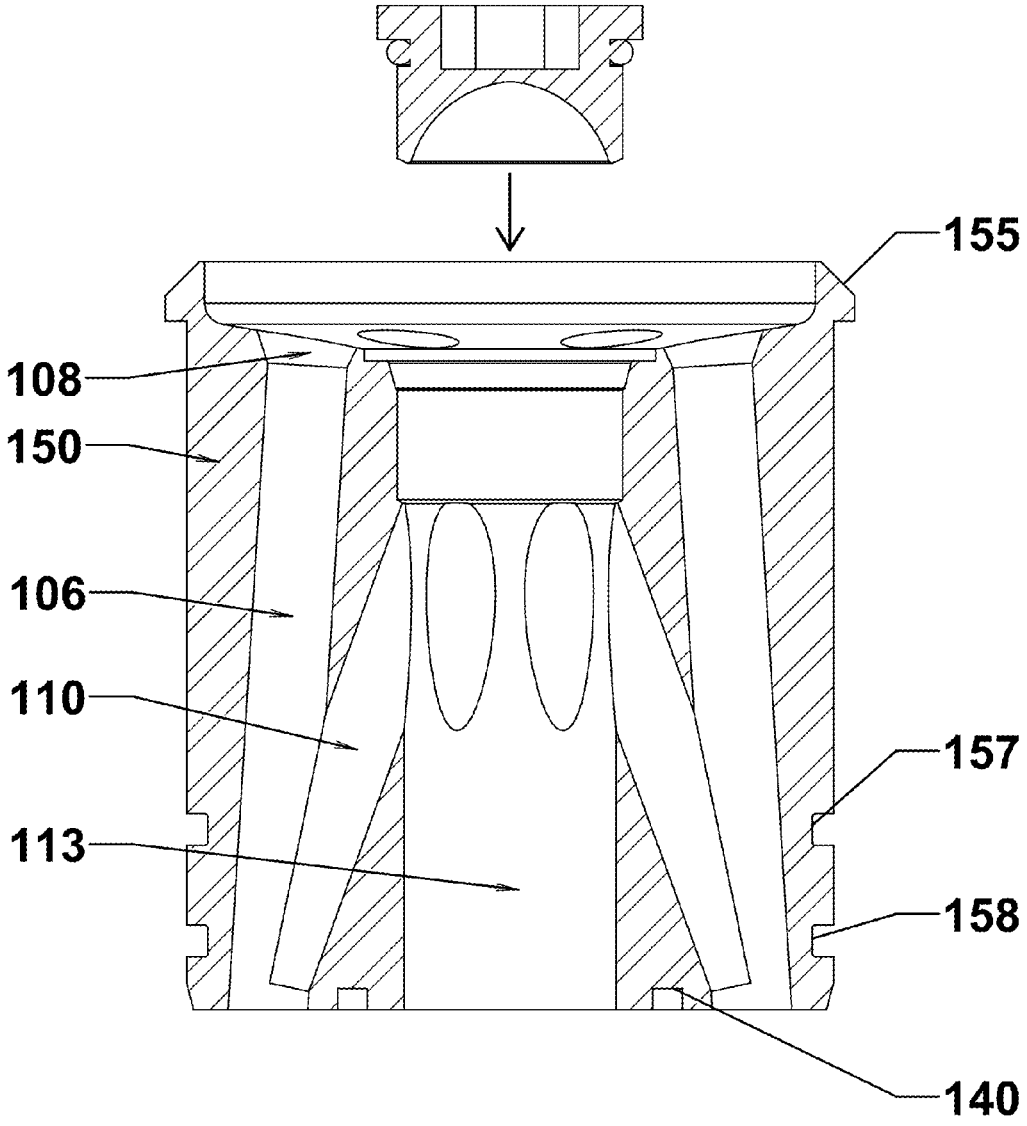
FIG. 8 depicts a side section view of the insertable cartridge of the present invention.

FIG. 8 depicts a side section view of insertable cartridge 150, showing parts through which fluid flows. Fluid supplied from the surface flows into tapered Venturi entrance port 108 and down through cartridge Venturi nozzle tube 106. Fluid returning from the bottom of the BHA flows upward into cartridge central fluid passageway 113 and into return fluid re-integration tube 110. Fluid in return fluid re-integration tube 110 flows downward to merge with the motive fluid from the surface flowing downward in cartridge Venturi nozzle tube 106.

Plug 144 may be inserted into insertable cartridge 150 to block fluid from the surface from flowing directly downward through the center of insertable cartridge 150 via cartridge central fluid passageway 113. Plug 144, when inserted into insertable cartridge 150, enables reverse circulation to occur, forcing fluid from the surface through tapered Venturi entrance ports 108, cartridge Venturi nozzle tubes 106, and exit ports 104, down the annular space, and then back upward through the center of shoe 160, collection chamber 170, tool body central return fluid passageway 112, cartridge central fluid passageway 113, and into return fluid re-integration tube 110. In the absence of plug 144, reverse circulation does not occur and fluid power unit 101 does not perform as designed.

The bottom side of plug 144 is formed with plug dome cavity 143, a curved surface designed to smooth return fluid flow and reduce turbulence as the return fluid makes the turn from cartridge central fluid passageway 113 and enters return fluid re-integration tubes 110. Different shapes may be utilized on the bottom side of plug 144 in place of plug dome cavity 143.

As an alternative to plug 144, and as is well known by those skilled in the art, a ball (not shown) may be "dropped," that is, inserted into the fluid stream supplied from the surface. The fluid stream will carry the ball into insertable cartridge 150 and seat at the upper opening of tool cartridge central fluid passageway 113 to block the flow, remaining seated in place due to a differential pressure present whenever fluid is supplied from the surface.

Figure 9:
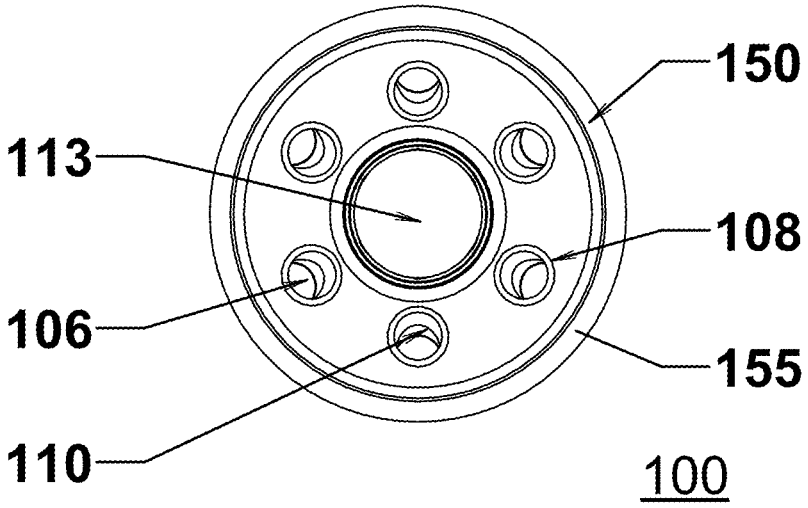
FIG. 9 depicts an overhead, top-down exterior view of the insertable cartridge of the present invention.

FIG. 9 depicts an overhead, top-down exterior view looking along the longitudinal axis of insertable cartridge 150 and through tool cartridge central fluid passageway 113, without plug 144 being inserted into place to obstruct the view. The upper surface of cartridge top sub-matching profile 155 is proximal to the observer. Distal from tapered Venturi entrance port 108 are cartridge Venturi nozzle tube 106 and the lower end of return fluid re-integration tube 110.

Figure 10:
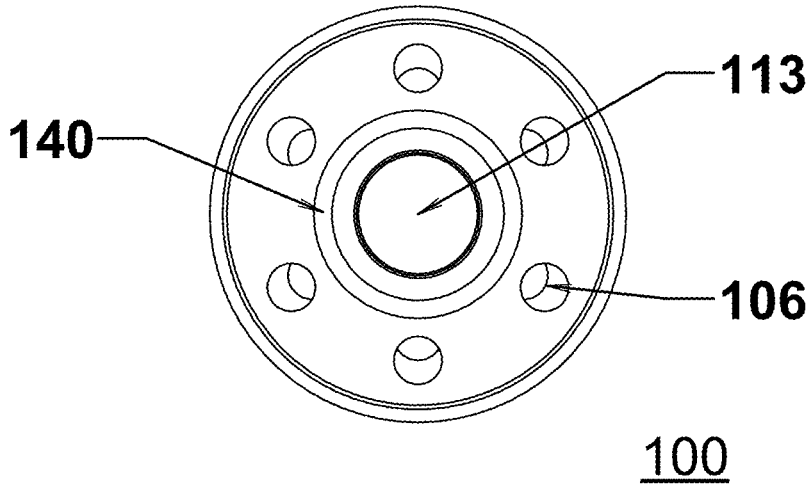
FIG. 10 depicts an underneath, bottom-up exterior view of the insertable cartridge of the present invention.

FIG. 10 depicts an underneath, bottom-up exterior view looking along the longitudinal axis of insertable cartridge 150 and through tool cartridge central fluid passageway 113, without plug 144 being inserted into place to obstruct the view. Cartridge lower central seal groove 140 is proximal to the observer. The proximal end of cartridge Venturi nozzle tube 106 contains combined fluid from return fluid re-integration tube 110 flow and fluid flow supplied from the surface.

Figure 11:
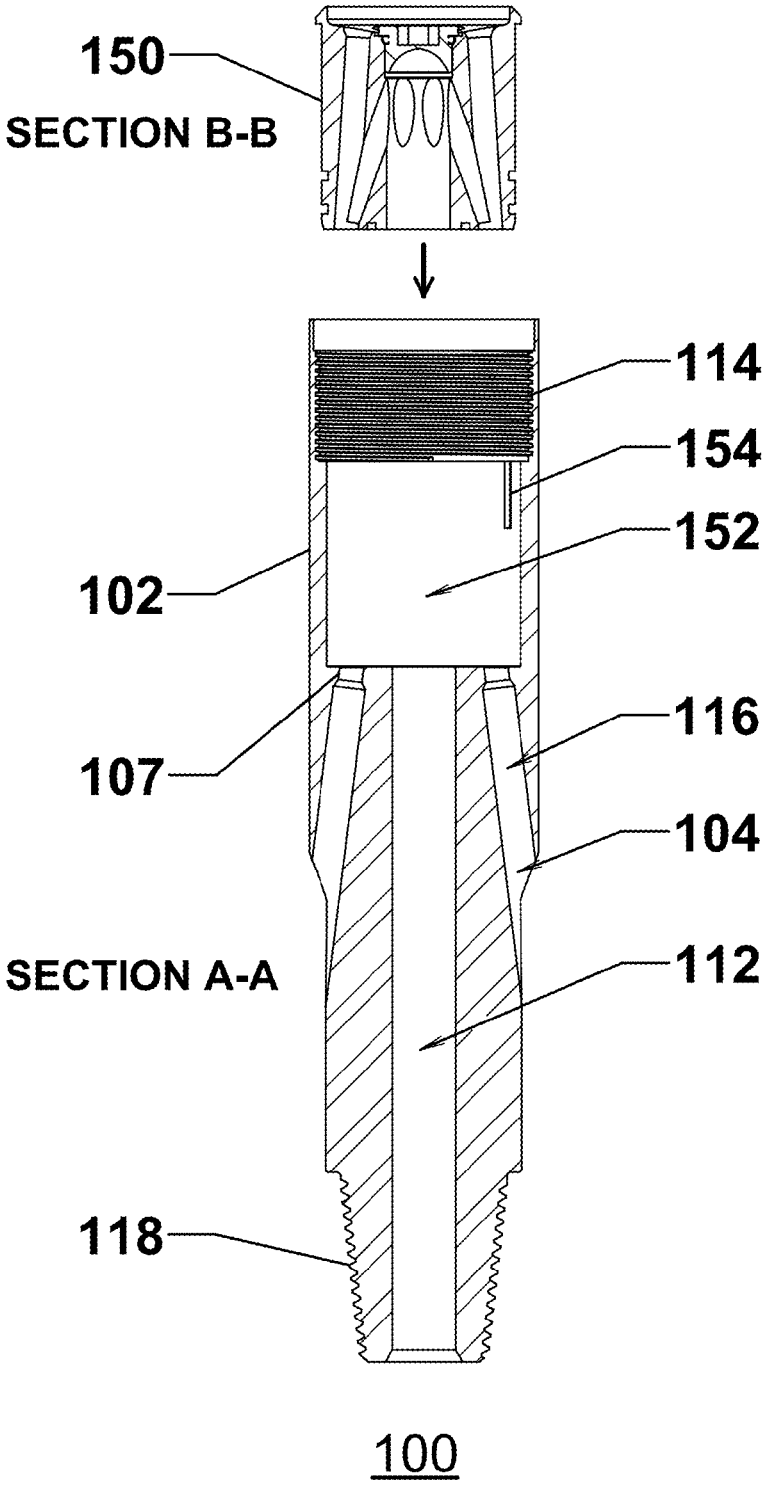
FIG. 11 depicts section views of the tool body and insertable cartridge of the present invention.

FIG. 11 depicts section views of tool body 102 and insertable cartridge 150 of exemplary embodiment 100, showing how insertable cartridge 150 inserts into cartridge cavity 152 of tool body 102. As described above, cartridge guiding keyway 156 functions in conjunction with tool body cartridge guiding keyway 154 and a key, not shown, but known to those skilled in the art, to ensure accurate insertion of insertable cartridge 150 into cartridge cavity 152, alignment of fluid passageways of insertable cartridge 150 and tool body 102, and resistance to rotation or torsion that could impair said alignment. FIG. 10 also depicts tool body upper threads 114 and tool body lower threads 118.

Figure 12:
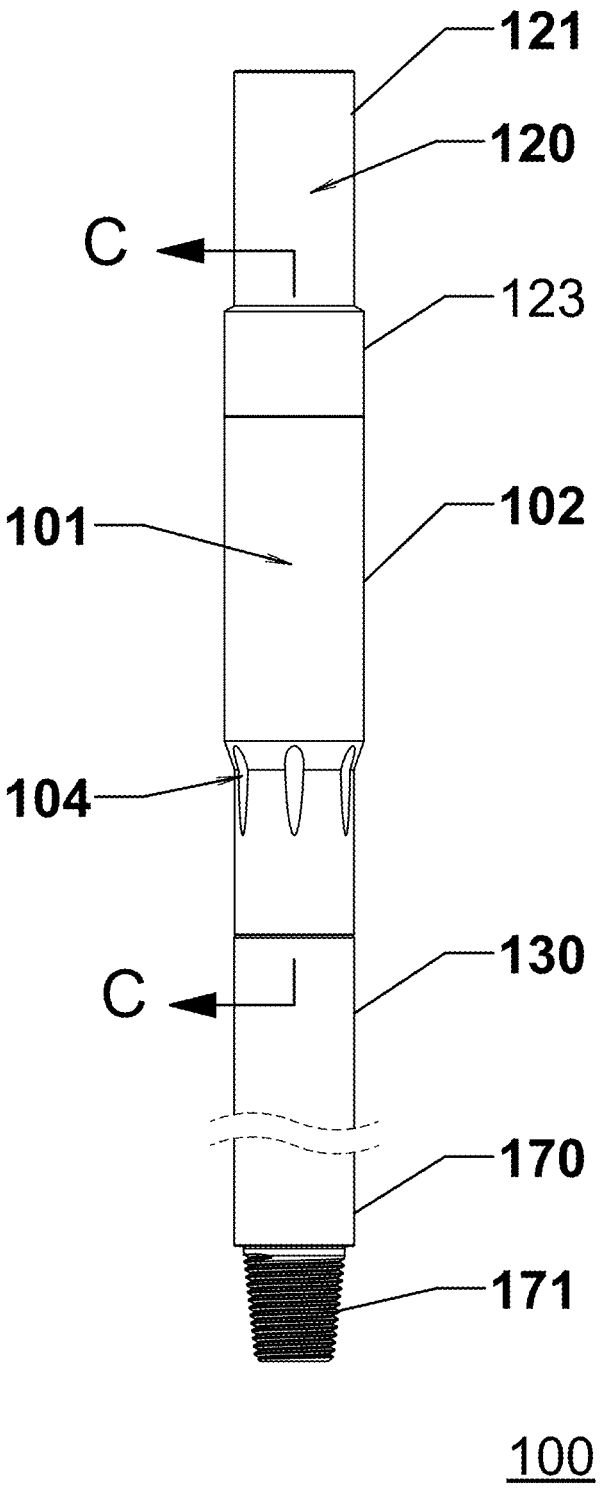
FIG. 12 depicts a side exterior view of key portions of the borehole assembly of the present invention.

FIG. 12 depicts a side exterior view of key portions of the BHA. This view includes tool body 102, top sub adapter 120, top sub adapter fishing neck 121, top sub adapter large diameter end 123, and bottom sub adapter 130. A break is shown from bottom sub adapter 130 to the lower end of collection chamber 170 and collection chamber threads 171. This view shows the BHA in an assembled state, including fluid power head 101 and tool body 102. Exit ports 104 are shown, indicating where fluid exits tool body 102.

Figure 13:
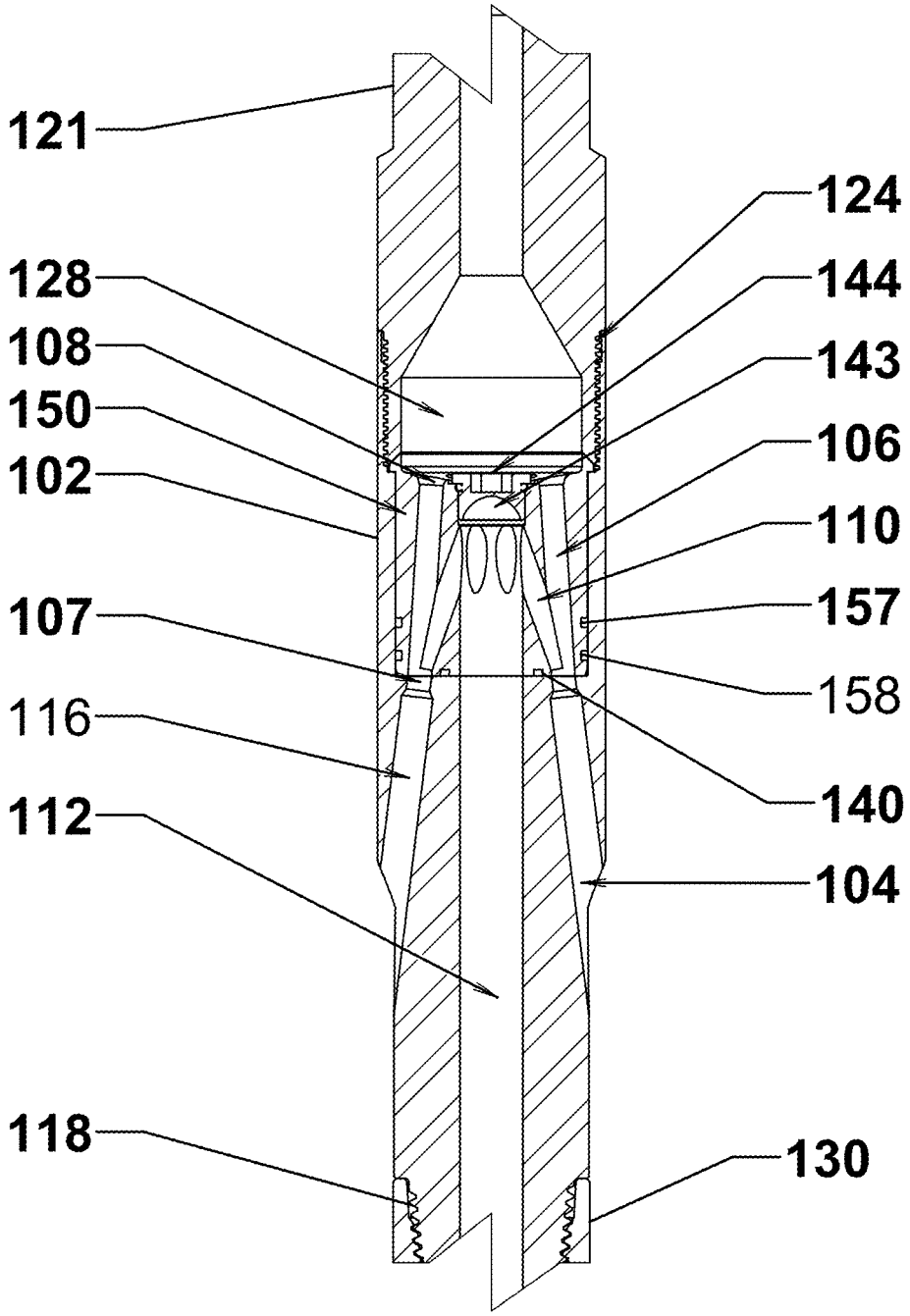
FIG. 13 depicts a more detailed view of a portion of FIG. 12.

FIG. 13 depicts a more detailed view of a portion of FIG. 12, including portions of tool body 102, top sub adapter 120, and bottom sub adapter 130 in an assembled state. Insertable cartridge 150 is shown inserted into position, receiving compressive force from top sub adapter 120 which is threaded into position. Plug 144 is shown in place below top sub adapter 120 and thus enables reverse circulation while blocking direct fluid flow between top sub fluid dispersion cavity 128 and tool body central return fluid passageway 112. Bottom sub adapter 130 is also shown threaded into position at the bottom end of tool body 102.

Fluid supplied from a surface pump passes through top sub adapter fishing neck 121 and into top sub fluid dispersion cavity 128, a space of larger inside diameter than the uphole portion of top sub adapter 120, allowing fluid to flow toward tapered Venturi entrance ports 108. Fluid next flows into tapered Venturi entrance port 108 and down through cartridge Venturi nozzle tube 106, where high-velocity and low pressure persist, and where fluid from the surface is merged with flow coming from return fluid re-integration tube 110.

Tool body Venturi nozzle tube 107 adjoins cartridge Venturi nozzle tube 106. The merged fluid flows continue downward into tool body Venturi nozzle tube 107 and then into mixing area 116 before leaving tool body 102 at exit ports 104 to continue downward into the annular space. For clarity in illustration, tool body Venturi nozzle tube 107 is shown as having the same diameter as cartridge Venturi nozzle tube 106. However, in practice, tool body Venturi nozzle tube 107 may have the same diameter as cartridge Venturi nozzle tube 106 where it abuts cartridge Venturi nozzle tube 106 and conically flare to the same diameter as mixing area 116. Alternatively, tool body Venturi nozzle tube 107 can be made the same diameter, over its entire length, as mixing area 116, resulting in a potential efficiency gain while simplifying sealing and fitting of insertable cartridge 150 to tool body 102.

Exemplary embodiment 100 shows a simple Venturi nozzle for simplicity and ease of manufacturing, and for durability in harsh downhole conditions. More intricate designs are known in the art, such as, for example, a discrete nozzle that emits fluid into the tapered inlet portion of a Venturi tube or a basic carburetor-style intake protruding into the narrowed high velocity Venturi area. The insertable cartridge system disclosed herein readily permits incorporation of more intricate Venturi-based pumping mechanisms.

Figure 14:
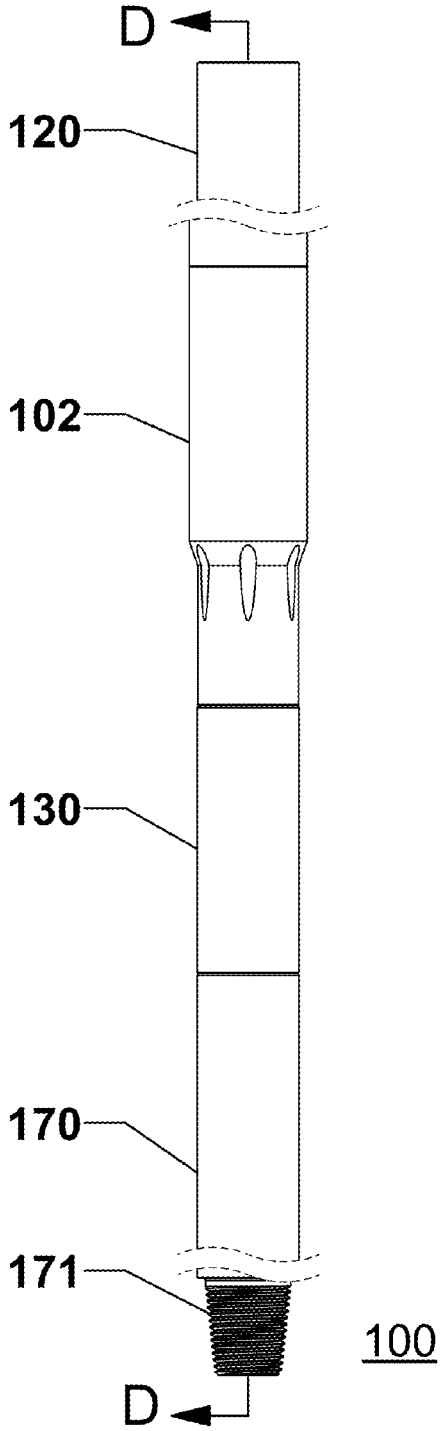
FIG. 14 depicts a side external view of significant portions of an assembled borehole assembly.

FIG. 14 depicts a side external view of significant portions of an assembled BHA. FIG. 14 includes top sub adapter 120, with a break indicating a shortened view, tool body 102, bottom sub adapter 130, collection chamber 170, with a break indicating a shortened view, and at the bottom, collection chamber threads 171.

Figure 15:
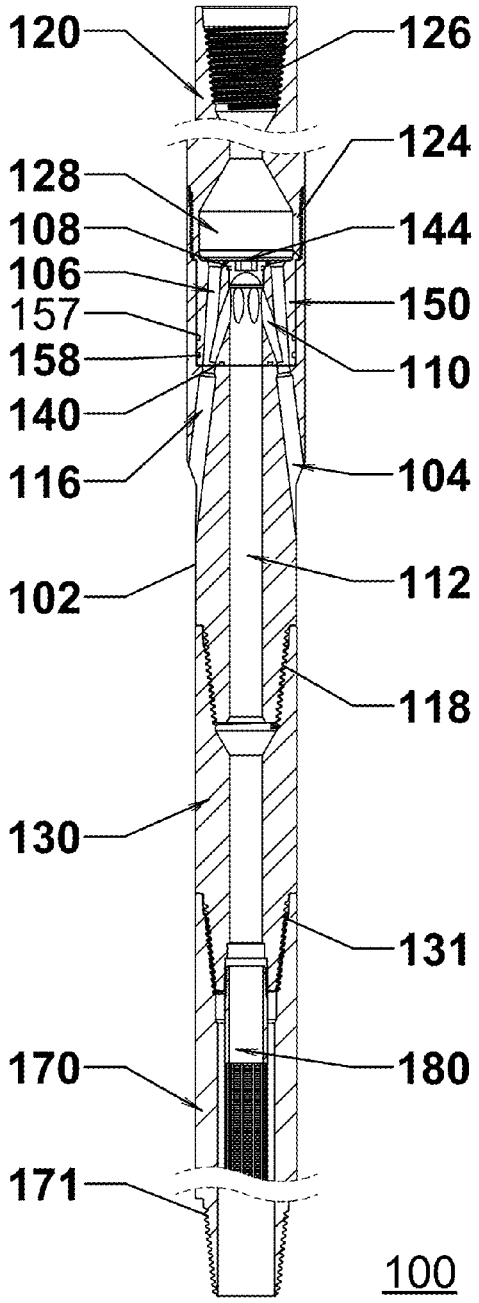
FIG. 15 depicts a half cross section corresponding to the external view of FIG. 14.

FIG. 15 depicts a half cross section corresponding to the external view of FIG. 14. FIG. 15 shows significant portions of exemplary embodiment 100, previously described, in an operation-ready state and connected to the BHA.

Figure 16:
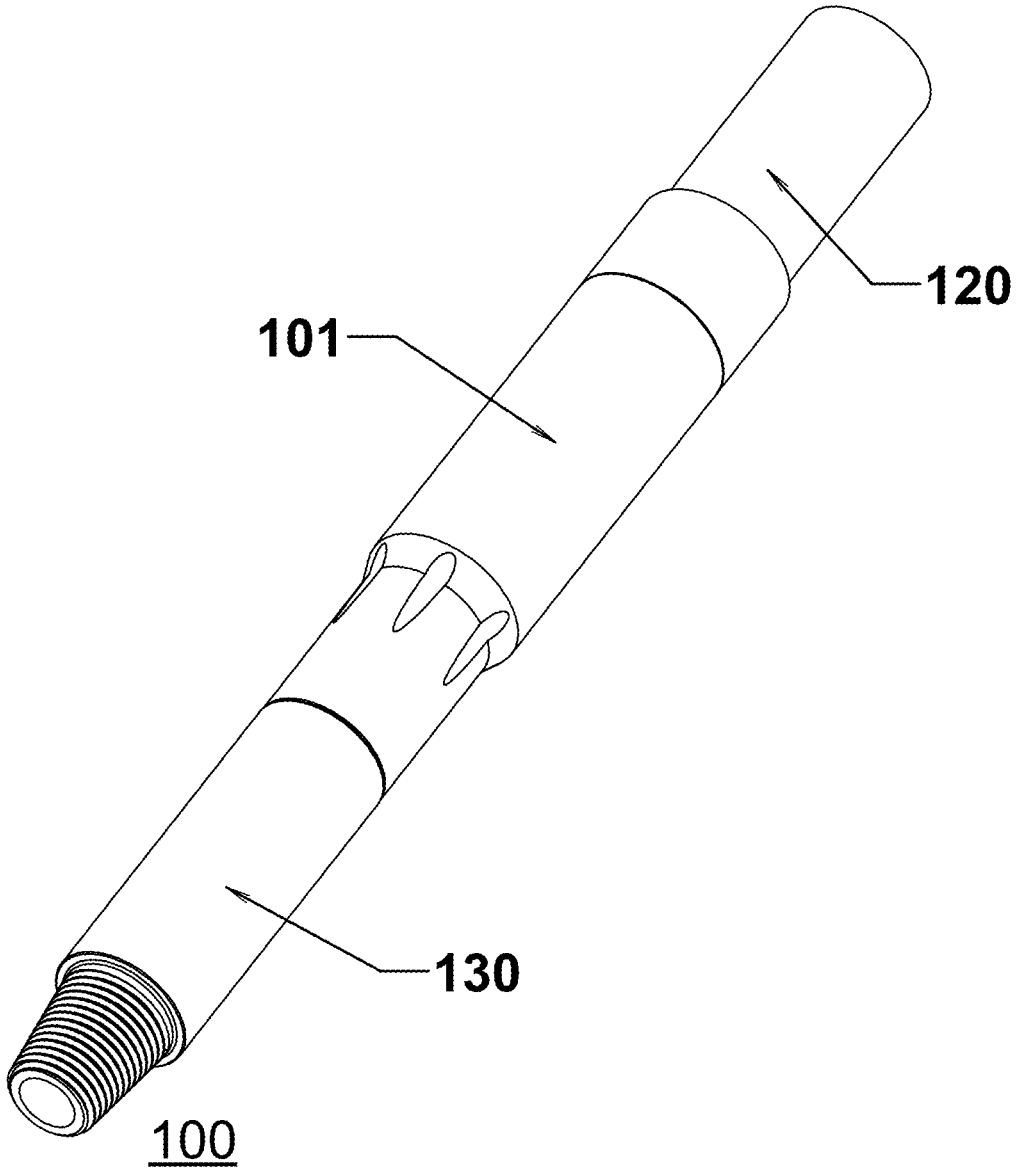
FIG. 16 depicts an external perspective view of an exemplary embodiment of the present invention.

FIG. 16 depicts an external perspective view of exemplary embodiment 100 with three key assembled components: fluid power head 101, top sub adapter 120, and bottom sub adapter 130. By changing connecting threads or dimensions, each of fluid power head 101, top sub adapter 120, and bottom sub adapter 130 may be adapted to meet a variety of downhole work string and BHA needs.

Thus, debris may be removed from a wellbore by providing work string 122, tool body 102, insertable cartridge 150, and collection chamber 170; drawing a fluid stream including entrained wellbore debris upward through collection chamber 170; and passing the fluid stream up from collection chamber 170, into cartridge central fluid passageway 113, through cartridge Venturi nozzle tubes 106 and through tool body exit ports 104 into the annular space of the wellbore.

Figure 17:
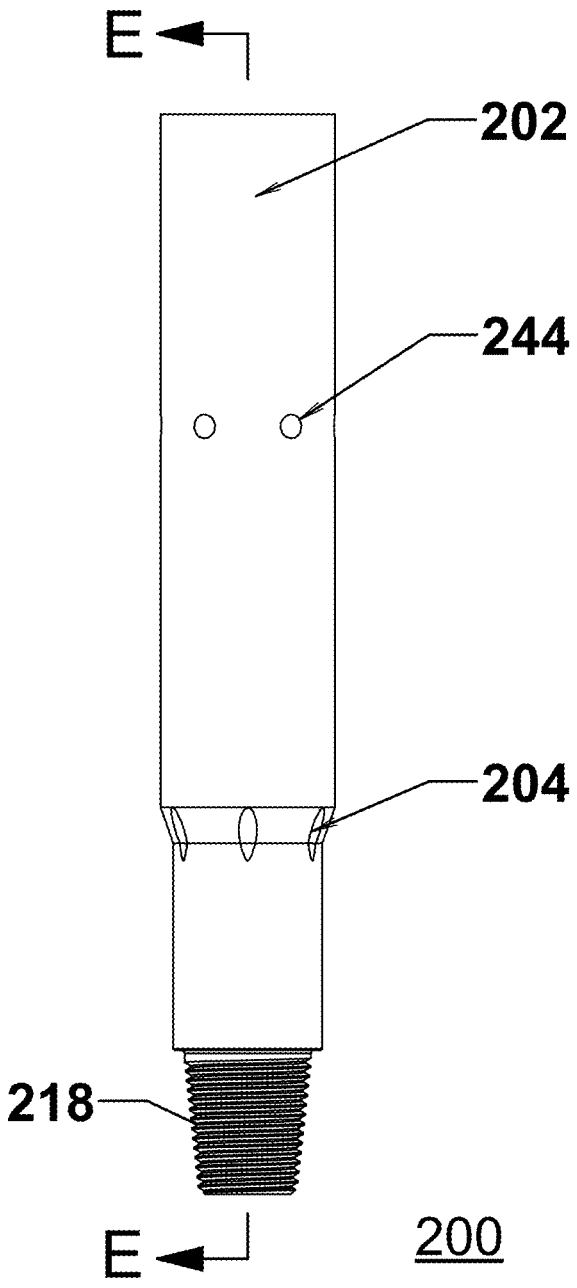
FIG. 17 depicts a side exterior view of an integrated tool body of a second exemplary embodiment of the present invention.
Figure 18:
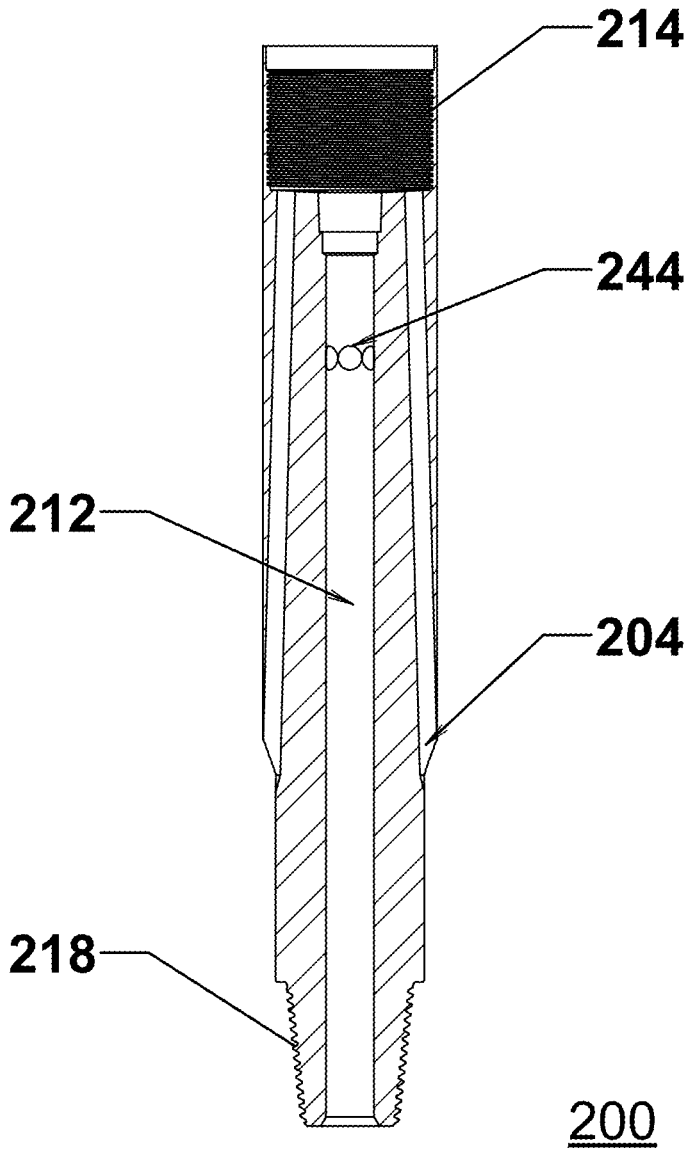
FIG. 18 depicts a side view cross section of the integrated tool body of the second exemplary embodiment of the present invention.

In exemplary embodiment 200, fluid power head 101, tool body 102, and insertable cartridge 150 are replaced by integrated tool body 202. FIG. 17 depicts a side exterior view of integrated tool body 202, and FIG. 18 depicts a side view cross section of integrated tool body 202. Required connections to other BHA components are made via tool body upper threads 214, again utilizing a fine thread for strength, and tool body lower threads 218, in the same manner as in exemplary embodiment 100.

Figure 19:
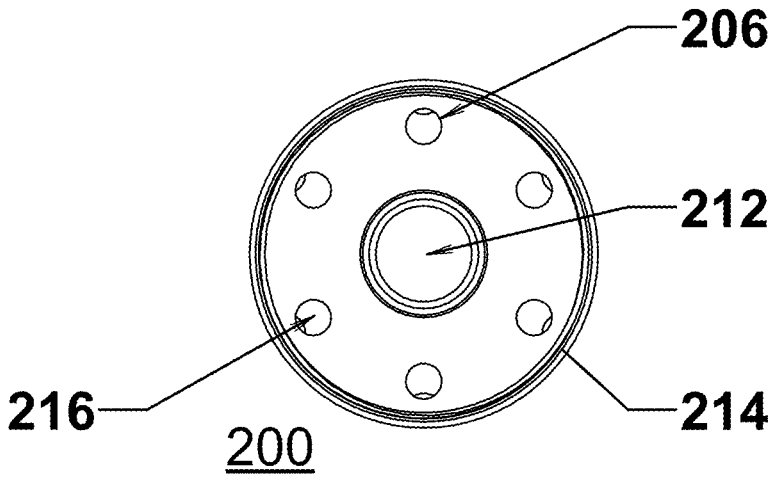
FIG. 19 depicts a top-down view of the integrated tool body of the second exemplary embodiment of the present invention.
Figure 20:
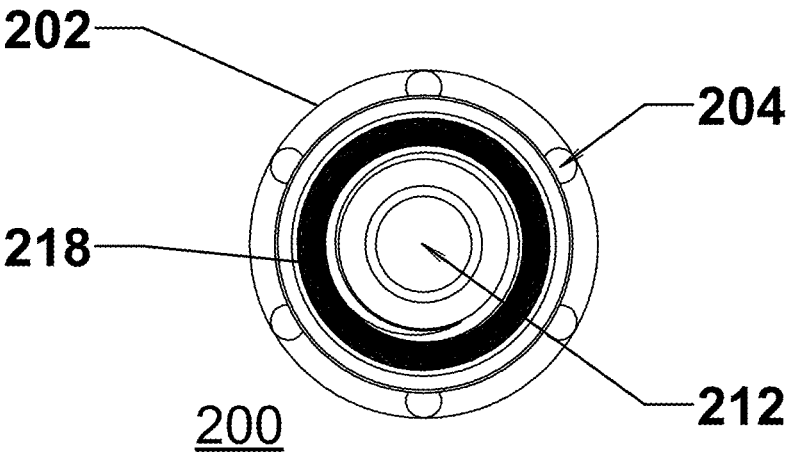
FIG. 20 depicts a bottom-up view of the integrated tool body of the second exemplary embodiment of the present invention.

FIG. 19 depicts a top-down view of integrated tool body 202, proximal to tool body upper threads 214, looking along the longitudinal axis through tool body central return fluid passageway 212. FIG. 20 depicts a bottom-up view of integrated tool body 202, proximal to tool body lower threads 218, looking along the longitudinal axis through tool body central return fluid passageway 212. Nozzle 216 indicates the orifice through which motive fluid will flow before exiting to the annular space at exit port 204. Similar to exemplary embodiment 100, exemplary embodiment 200 uses six circumferentially equally spaced nozzles 216 and exit ports 204. While exemplary embodiment 200 uses six nozzles, any number of nozzles distributed around the lateral circumference of tool body 202 could be utilized to deliver circumferentially distributed fluid flow from tool body 202 into the annular space.

Exemplary embodiment 200 utilizes reverse circulation much like exemplary embodiment 100, utilizing a plug at the upper, larger diameter portion of central return fluid passageway 212 indicated by location 220 (not shown, but similar to plug 144 above) or ball drop method to execute the reverse circulation. However, in exemplary embodiment 200, low pressure inducing suction is generated in the annular space. In particular, exemplary embodiment 200 does not mix fluid supplied from the surface and the return fluid within integrated tool body 202. Instead, fluid supplied from the surface passes through a cavity interior to tool body upper threads 214 and flows down to exit tool body 202 at high velocity through exit ports 204. Thus, low pressure and high velocity flow occur in the vicinity of exit ports 204. Return fluid flow, having traveled up through the center of the BHA, exits integrated tool body 202 via return fluid exit ports 244 into the annular space, drawn toward exit ports 204 due to low pressure occurring proximal to exit ports 204. Thus, in exemplary embodiment 200, fluid supplied from the surface and return fluid mix near exit ports 204, in the annular space.

With straight bores through integrated tool body 202, exemplary embodiment 200 may be more easily manufactured than exemplary embodiment 100. Return fluid exit ports 244 and exit ports 204 may be located, in relation to each other, as deemed most effective in generating suction.

Exemplary embodiment 200 also has the advantage of optional ball-drop-selectable nozzle closure. Such ball-drop-selectable nozzle closure acts to modify fluid stream flow and debris removal force at the point accelerated fluid exits nozzles 216 and exit ports 204.

As noted above, exemplary embodiment 200 makes use of a plurality of nozzles 216 distributed around the 360-degree circumference of integrated tool body 202. During a debris removal operation, a wide variety of circumstances may be encountered, and the unseen downhole conditions may present unusual challenges to crew conducting the operation. By nature, the unknowns in oil and gas operations incentivize trial-and-error experimentation. Considering the unknown nature of wellbore debris obstructions, and taking into account pressure and flow data, the crew may wish to alter fluid flow within the tool during an operation. Fluid flow may be altered by inserting appropriately-sized balls into the supplied fluid at the surface, executing a "ball drop" according to industry parlance. The ball will go to the entrance of the nozzle 216 that is experiencing the highest flow rate of the plurality of nozzles 216, and serve to obstruct the particular nozzle 216 for the duration of the debris removal operation. Additional balls may be dropped to obstruct more nozzles. Closure of one or more nozzles 216 will alter the higher velocity flow in proximity to the tool and potentially alter vorticity and turbulence at the distal end of the adjacent assembly. Reynolds numbers in the annular space would increase. Thus turbulence and debris agitation along the annular space and at the distal end where debris is pulled into collection chamber 170 may be modified to suit a particular drilling situation.

The optional ball-drop-selectable nozzle closure, described above, enables effective wellbore debris removal operations when, for whatever reason, available surface pumping capacity is less than optimal. For example, and strictly hypothetically, assume that optimal surface pumping capacity is 3 barrels per minute, but the available surface pumping capacity is only 2 barrels per minute, and flow normally goes through six nozzles at the downhole tool. The tool would not function optimally with this reduced pumping capacity. However, on-site adjustments may enable adequate function. In this example, two balls could be dropped, closing two nozzles, or one third of the flow. Such a closure would allow wellbore debris removal, albeit with lesser efficiency than designed or planned, making use of sub-optimal available surface pumping capacity. With time being of the essence in virtually all oil and gas operations, the disclosed subject matter's ability to adjust in real time to sub-optimal conditions and execute an operation provides significant value to an operator facing unpredictable real-world circumstances.

Thus, debris may be removed from a wellbore by providing work string 122, tool body 202, and collection chamber 170; drawing a fluid stream down from the top of the wellbore through nozzle tubes 216 and exit ports 204, drawing a fluid stream including entrained wellbore debris upward through collection chamber 170; and passing the fluid stream up from collection chamber 170, into tool body 202, and through return fluid exit ports 244 into the annular space of the wellbore.

Figure 21:
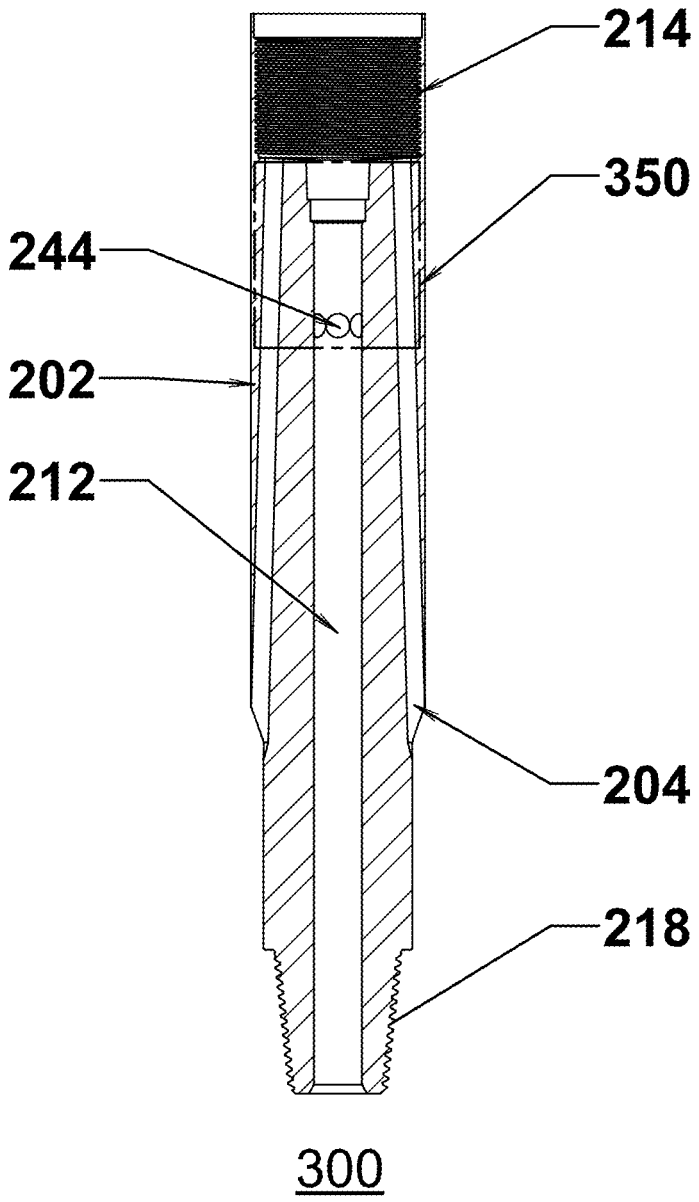
FIG. 21 depicts a cross section of a third exemplary embodiment of the present invention.

FIG. 21 depicts a cross section of exemplary embodiment 300. Exemplary embodiment 300 is similar in fluid-flow function to exemplary embodiment 200. However, exemplary embodiment 300 employs an insertable cartridge 350 that is inserted into tool body 302 in similar fashion as exemplary embodiment 100's insertable cartridge 150. Insertable cartridge 350 is shown inserted into place inside the upper portion of tool body 202.

In exemplary embodiment 300, flows occur in the same manner as exemplary embodiment 200, with the suction effect concentrated in the annular space and with no mixing of return fluid and motive fluid inside tool body 202. In particular, in exemplary embodiment 300, low pressure and high velocity flow occur in the vicinity of exit ports 204. Return fluid flow, having traveled up through the center of the BHA, exits integrated tool body 202 via return fluid exit ports 244 into the annular space, drawn toward exit ports 204 due to low pressure occurring proximal to exit ports 204. Thus exemplary embodiment 300 combines the flow and suction of exemplary embodiment 200 with the insertable cartridge design of exemplary embodiment 100. Exemplary embodiment 300 may also be used with the optional ball-drop-selectable nozzle closure described above with reference to exemplary embodiment 200.

Thus, debris may be removed from a wellbore by providing work string 122, tool body 202, insertable cartridge 350 inserted into tool body 302, and collection chamber 170; drawing a fluid stream down from the top of the wellbore through nozzle tubes 216 and exit ports 204, drawing a fluid stream including entrained wellbore debris upward through collection chamber 170; and passing the fluid stream up from collection chamber 170, into insertable cartridge 350, and through return fluid exit ports 244 into the annular space of the wellbore.

In light of the above, the present disclosure provides a method and apparatus for removing debris from a wellbore, comprising providing a surface pump for supplying a fluid stream, a work string fluidly connected to the surface pump for passing the fluid stream from the surface pump, a tool body fluidly connected to the work string, including a plurality of tool body exit ports for passing the fluid stream from the work string into an annular space of the wellbore, and a collection chamber fluidly connected to and downhole from the tool body, for accepting uphole flow of the fluid stream including entrained wellbore debris. The fluid stream including entrained wellbore debris is drawn upward through the collection chamber, and the fluid stream from the work string and the fluid stream from the collection chamber are passed into the annular space of the wellbore. In addition, a cartridge may be inserted into the tool body.

The disclosed subject matter allows the suction achieved using a low pressure flow area in the annular space to be adjusted for wellbore conditions or suboptimal fluid pumping capacity, allowing customization to a particular drilling situation while remaining strong enough to withstand wellbore operations.

All references, including publications, patent applications, and patents, cited herein are hereby incorporated by reference to the same extent as if each reference were individually and specifically indicated to be incorporated by reference and were set forth in its entirety herein.

The detailed description set forth herein in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. An apparatus for removing debris from a wellbore, comprising:

a work string, for passing a fluid stream from a top of the wellbore;

a tool body fluidly connected to the work string, including a plurality of tool body exit ports for passing the fluid stream from the work string into an annular space of the wellbore;

a collection chamber fluidly connected to and downhole from the tool body, for accepting uphole flow of the fluid stream including entrained wellbore debris; and a cartridge, insertable into the tool body, including a cartridge central fluid passageway and a plurality of cartridge Venturi nozzle tubes distributed around the lateral circumference of the cartridge, wherein each Venturi nozzle tube is fluidly connected to one of the plurality of tool body exit ports, the cartridge Venturi nozzle tubes for providing suction inside the cartridge, drawing the fluid stream up from the collection chamber, into the cartridge central fluid passageway, then directly into and through the cartridge Venturi nozzle tubes and through the tool body exit ports into the annular space of the wellbore, wherein the cartridge is fixed to the tool body, thereby precluding relative movement of the cartridge along a central axis of the tool body.

2. The apparatus of claim 1, the tool body further comprising a tool body Venturi nozzle tube fluidly connected to each tool body exit port.

3. The apparatus of claim 1, further comprising:

a top sub adapter, for connecting the tool body to the workstring;

a bottom sub adapter, for connecting the tool body to the collection chamber;

and wherein the tool body further comprises:

an upper threaded portion, for connecting the tool body to the top sub adapter; and a lower threaded portion, for connecting the tool body to the bottom sub adapter.

4. The apparatus of claim 3, wherein the cartridge further comprises a cartridge top sub-matching profile, said cartridge top sub-matching profile comprising a shape matching the bottom of the top sub adapter and a downwardly-sloping bevel, for providing a self-centering profile and equal distribution of compressive force for sealing.

5. The apparatus of claim 1, further comprising a plug for insertion into the cartridge, for forcing the fluid stream from the workstring through the cartridge Venturi nozzle tubes and preventing the fluid stream from the workstring from flowing directly through the cartridge central fluid passageway.

6. The apparatus of claim 5, the plug further comprising a shaped bottom surface for reducing turbulence of fluid flow from the cartridge central fluid passageway.

7. The apparatus of claim 1, the tool body further comprising a tool body cartridge guiding keyway and the cartridge further comprising a corresponding cartridge guiding keyway, for ensuring alignment of each of the cartridge Venturi nozzle tubes with each of the tool body exit ports when the cartridge is inserted into the tool body.

8. The apparatus of claim 1, the cartridge further comprising an upper cartridge seal groove and a lower cartridge seal groove, for housing seals and preventing flow leakage between the cartridge and the tool body.

9. The apparatus of claim 1, the cartridge further comprising a plurality of return fluid re-integration tubes, wherein each return fluid re-integration tube is fluidly connected to a corresponding tool body exit port and to the central fluid passageway.

10. A method for removing debris from a wellbore, comprising: providing a work string, for passing a fluid stream from a top of the wellbore;

a tool body fluidly connected to the work string, including a plurality of tool body exit ports for passing the fluid stream from the work string into an annular space of the wellbore;

a collection chamber fluidly connected to and downhole from the tool body, for accepting uphole flow of the fluid stream including entrained wellbore debris; and a cartridge, insertable into the tool body, including a cartridge central fluid passageway and a plurality of cartridge Venturi nozzle tubes distributed around the lateral circumference of the cartridge, wherein each Venturi nozzle tube is fluidly connected to one of the plurality of tool body exit ports, the cartridge Venturi nozzle tubes for providing suction inside the cartridge, drawing the fluid stream up from the collection chamber, into the cartridge central fluid passageway, then directly into and through the cartridge Venturi nozzle tubes and through the tool body exit ports into an annular space of the wellbore, wherein the cartridge is fixed to the tool body, thereby precluding relative movement of the cartridge along a central axis of the tool body;

drawing the fluid stream including entrained wellbore debris upward through the collection chamber;

passing the fluid stream from the work string and the fluid stream from the collection chamber into the annular space of the wellbore.

* * * * *